US009032659B1

(12) United States Patent
Duneman

(10) Patent No.: US 9,032,659 B1
(45) Date of Patent: May 19, 2015

(54) ROTATABLE FOREARM/HAND-GUARD ASSEMBLY FOR A FIREARM

(71) Applicant: Scott A. Duneman, Wayzata, MN (US)

(72) Inventor: Scott A. Duneman, Wayzata, MN (US)

( * ) Notice: Subject to any disclaimer, the term of this patent is extended or adjusted under 35 U.S.C. 154(b) by 0 days.

(21) Appl. No.: 14/291,272

(22) Filed: May 30, 2014

Related U.S. Application Data

(62) Division of application No. 13/414,050, filed on Mar. 7, 2012, now abandoned.

(60) Provisional application No. 61/464,695, filed on Mar. 8, 2011.

(51) Int. Cl.
*F41C 23/00* (2006.01)
*F41C 27/00* (2006.01)
*F41C 23/16* (2006.01)

(52) U.S. Cl.
CPC ..... *F41C 27/00* (2013.01); *F41C 23/16* (2013.01)

(58) Field of Classification Search
CPC ..... F41C 23/14; F41C 23/16
USPC ..... 42/71.01, 73, 90, 94
See application file for complete search history.

(56) References Cited

U.S. PATENT DOCUMENTS

| | | | | |
|---|---|---|---|---|
| 4,366,973 | A * | 1/1983 | Brekke | 285/276 |
| 5,068,992 | A * | 12/1991 | Velezis et al. | 42/72 |
| 5,417,002 | A * | 5/1995 | Guerra | 42/72 |
| 8,667,726 | B1 * | 3/2014 | Huff | 42/71.01 |
| 8,739,448 | B2 * | 6/2014 | Kimmel et al. | 42/71.01 |
| 2006/0053673 | A1 * | 3/2006 | Murello | 42/71.01 |
| 2007/0094912 | A1 * | 5/2007 | Bender | 42/94 |
| 2009/0044439 | A1 * | 2/2009 | Phillips et al. | 42/72 |

* cited by examiner

*Primary Examiner* — Gabriel Klein
(74) *Attorney, Agent, or Firm* — Brooks, Cameron & Huebsch PLLC

(57) ABSTRACT

A forearm/hand-guard assembly for a firearm including a generally tubular member through which a barrel of the firearm extends. The tubular member includes structure to which one or more attachments such as different types of sights may be secured. Bearings support the tubular member around the barrel and afford rotation of the tubular member and attachments it carries around the barrel between different positions relative to the barrel; and a retainer releasably retains the generally tubular member in one or more of those positions relative to the barrel.

9 Claims, 7 Drawing Sheets

ROTATABLE FOREARM/HAND-GUARD ASSEMBLY FOR A FIREARM

CROSS REFERENCE

The present application is related to and claims priority to U.S. Provisional Application No. 61/464,695 filed on Mar. 8, 2011, and U.S. application Ser. No. 13/414,050 filed on Mar. 2, 2012, the disclosures of which are incorporated in their entirety herein by reference.

FIELD OF THE INVENTION

The present invention relates to forearm/hand-guard assemblies used around the barrels of firearms.

BACKGROUND

Forearm/hand-guard assemblies for firearms (especially rifles) are well known that include a tubular member adapted to extend around a barrel of the firearm and include means, such as one or more Picatinny or Weaver style rails that are adapted for engagement by one or more attachments (e.g., open sights, red dot sights, scopes, lasers, or lights) to secure those attachments along the outer surface of the tubular member. Known firearm forearm/hand-guard assemblies of this type are attached to the firearms in fixed relationship to their barrels. This can present difficulties for a user of the firearm when, for example, the user wishes to switch between the use of a scope sight and an open sight, which sights are fixed on adjacent sides of the forearm/hand-guard assembly for the firearm. Switching use of those sights may require holding the firearm in an inconvenient position to afford use of the one of those sights that is not above the normal top of the barrel.

Also, the use of such a forearm/hand-guard assembly fixed with respect to a rifles barrel can present an additional problem when used on a rifle of the type commercially designated "SUB-2000" that is commercially available from Kel-Tec CNC Industries, Cocoa, Fla. 32923. That rifle has a barrel mounted on its receiver for pivotal movement between a use portion in which the barrel projects away from a receiver for the rifle in the normal orientation so that the rifle can be used to fire cartridges, and a storage position in which the barrel is pivoted about 180 degrees around its juncture with the receiver of the rifle so that the barrel lies along the top of the receiver and a stock for the rifle and the rifle can then be conveniently stored in a small storage case. An attachment such as a scope attached along the normal top of such a forearm/hand-guard assembly fixed to the barrel on such a rifle can prevent that barrel from moving fully to its storage position (i.e., the top of the scope touches the top of the stock before that storage position is reached), thereby requiring removal of the scope or a larger case to store the rifle.

DISCLOSURE OF THE INVENTION

The present invention provides a forearm/hand-guard assembly for a firearm that includes a tubular member adapted to extend around a barrel of the firearm and includes means, (such as one or more Picatinny or Weaver style rails), adapted for engagement to secure one or more attachments (e.g., open sights, red-dot sights, scopes, lasers, or lights) along the outer surface of the tubular member. The assembly also includes bearing means adapted for supporting the tubular member around the barrel to afford rotation of the tubular member between different positions relative to the barrel so that different ones of such attachments may be located in positions either where they are most conveniently used on the rifle, or where they will not interfere with use of other attachments or storage of the rifle. Retaining means are also provided for releasably retaining the tubular member in one or more of such relative positions with respect to the barrel.

Thus, for example, with the present invention if a user of a rifle wishes to switch between the use of a scope sight and an open sight, both of which are fixed on different sides of the forearm/hand-guard assembly for the rifle, the user can rotate the forearm/hand-guard to position the sight he wishes to use in the normal position above the barrel and move the other sight away from that position. Such switching can be easily done by releasing the retaining means to afford manual rotation of the tubular member to move the sights, and re-engaging the retaining means when the desired sight is in the desired position.

Also, for a rifle of the type commercially designated "SUB-2000" from Kel-Tec CNC Industries, Inc., described above, the use of the present invention allows use of a rifle scope sight when the barrel of the rifle is in its use position, and, when it is desire to store the rifle, allows that rifle scope to be rotated to one side or below that forearm/hand-guard assembly so that the barrel can be moved fully to its storage position and the rifle can be stored in a small case.

In one embodiment of the forearm/hand-guard assembly according to the present invention the bearing means used to support it on the firearm comprises the inner surface of the tubular member having cylindrical inner surface portions adjacent the opposite ends of the tubular member, and two inner bearing portions having through openings adapted to receive portions of the barrel. The inner bearing portions include means for securing the inner bearing portions in fixed positions on the barrel, and outer cylindrical surfaces adapted to be received in the cylindrical inner surface portions of the tubular member to afford rotation of the tubular member around the inner bearing portions; and the retaining means includes a retaining member adapted for releasable engagement between one of the bearing portions and the tubular member.

In another embodiment of the forearm/hand-guard assembly according to the present invention the tubular member is an assembly of first and second parts, attached together by screws, and the bearing means comprises two bearing assemblies each including an outer bearing portion having an inner cylindrical surface portion. The inner surface of the tubular member engages outer peripheral surfaces of the outer bearing portions with the outer bearing portions in spaced relationship and adjacent opposite ends of the tubular member, and the parts of the tubular member are held in firm engagement with the outer bearing portions by the screws that bias those parts of the tubular member toward each other. The bearing assemblies also include inner bearing portions having outer cylindrical surfaces adapted to be received in the cylindrical inner surface portions of the outer bearing portions to afford rotation of the tubular member around the inner bearing portions. Also, the inner bearing portions have surfaces defining through cylindrical openings adapted to receive spaced portions of the barrel in close fitting relationship together with means for securing the inner bearing portions on the barrel extending through their through openings, and the retaining means includes a retaining member adapted for releasable engagement between one of the inner bearing portions and the tubular member.

In yet another embodiment of the forearm/hand-guard assembly according to the present invention the bearing means used to support it on the barrel comprises two ball bearings and a bearing support member having a through opening adapted to receive a portion of the barrel, means for securing the bearing support member in a fixed position on the receiver of the firearm with its barrel extending through the through opening, and an outer surface engaged with inner surfaces of inner portions of the ball bearings. The inner surface of the tubular member has a portion adapted to engage outer peripheral surfaces of outer portions of the ball bearings, and the retaining means includes a retaining member adapted for releasable engagement between the bearing support member and the tubular member.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
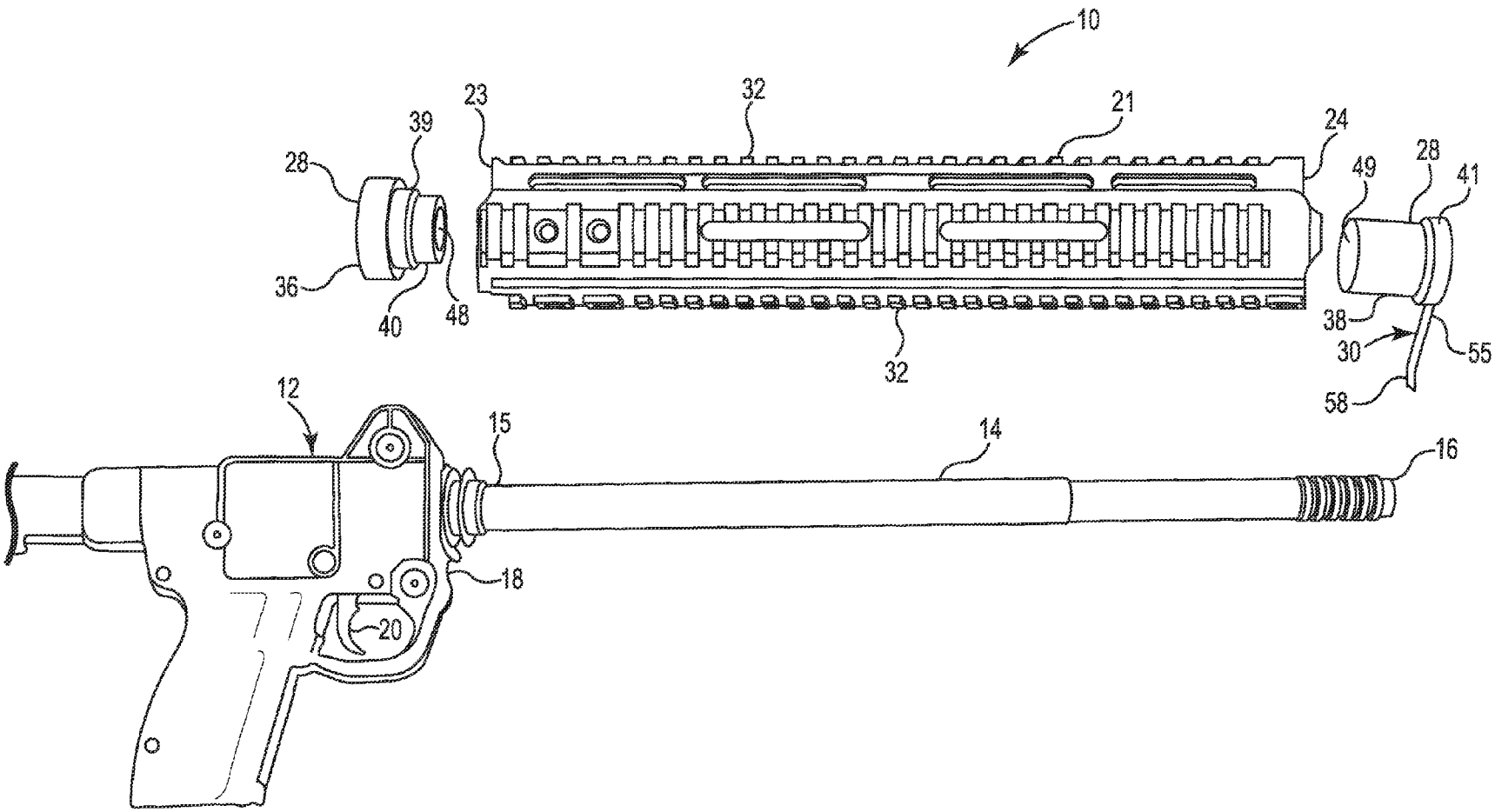
FIG. 1 is a side view of a first embodiment of a forearm/hand-guard assembly according to the present invention and of a firearm (a stock portion of which has been broken away) on which the forearm/hand-guard assembly is adapted to be used, the forearm/hand-guard assembly being shown separated from the firearm.

With reference to FIGS. 1 through 5 there is illustrated a first embodiment of a forearm/hand-guard assembly according to the present invention, which assembly is generally designated by the reference numeral 10; together with a firearm or rifle 12 on which the assembly 10 is adapted to be used.

The firearm 12 is the rifle commercially designated the "SUB-2000" from Kel-Tec CNC Industries, Inc. that is described above. The rifle 12 includes an elongate barrel 14 having opposite chamber and muzzle ends 15 and 16 and a through bore from a chamber at its chamber end 15 to its muzzle end 16, a receiver 18 to which the chamber end 15 of the barrel 14 is attached, which receiver 18 includes means for securing a loaded cartridge in the chamber in the barrel 14, and means for affording manually activated firing of that cartridge by use of a trigger 20.

The forearm/hand-guard assembly 10 comprises an elongate generally tubular member 21 having an axis 22, and first and second opposite axially spaced ends 23 and 24. The tubular member 21 includes means adapted for engagement to secure one or more attachments (e.g., open sights, red dot sights, scopes, lasers, or lights) along an outer surface of the tubular member 21. The tubular member 21 has an inner surface 26 defining a through opening between its ends 23 and 24, which inner surface 26 is adapted to extend around the barrel 14 of the rifle 12 with the inner surface 26 spaced from the barrel 14. The assembly 10 also includes bearing means 28 adapted for engagement with the rifle 12 for supporting the tubular member 21 around the barrel 14 from both ends of the tubular member 21. The bearing means 28 affords rotation of the tubular member 21 around the barrel 14 between different positions relative to the barrel 14; and the assembly includes retaining means 30 for releasably retaining the generally tubular member 21 in at least one of those positions (and as illustrated, in two of those positions) relative to the barrel 14.

The tubular member 21 illustrated was made by modifying the forearm structure sold under the trade designation "Full length Free Float Handguard one piece tubular/Quad Rail" that is manufactured by Daniel Defense, Inc., Black Creed, Ga. 31308. The means adapted for engagement to secure one or more attachments along the outer surface of the tubular member 21 comprises four picatinny rails 32 attached along the outer surface of the tubular member 21. The rails 32 extend between the ends 23 and 24 of the tubular member 21, and are generally equally spaced around the outer surface of the tubular member 21. Alternatively, the tubular member 21 could be a hollow tube with a generally cylindrical, rectangular, or other outer surface shape that has attached to its outer surface (e.g., as by soldering, welding, rivets, screws or otherwise) at least one or more structures such as picatinny rails, Weaver style rails, or bases for scope rings that extend at least partially between its ends; or the tubular member could be tapped so attachments could be engaged directly to its outer surface by screws to provide the means adapted for engagement to secure one or more attachments along its outer surface.

Figure 2:
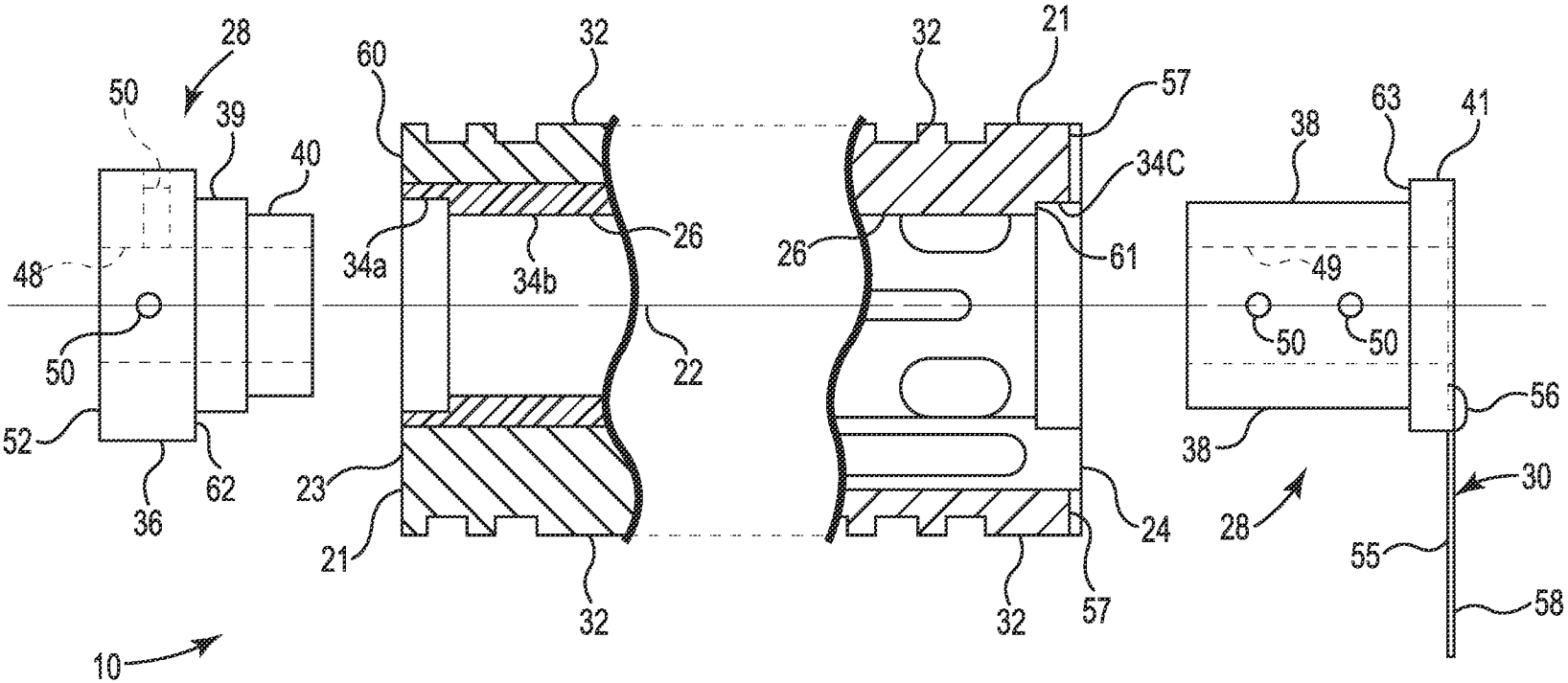
FIG. 2 is an enlarged side view of first and second inner bearing members and opposite end fragments of a tubular member included in the first embodiment of the forearm/hand-guard assembly shown in FIG. 1, which tubular member fragments have been sectioned to show details.
Figure 3:
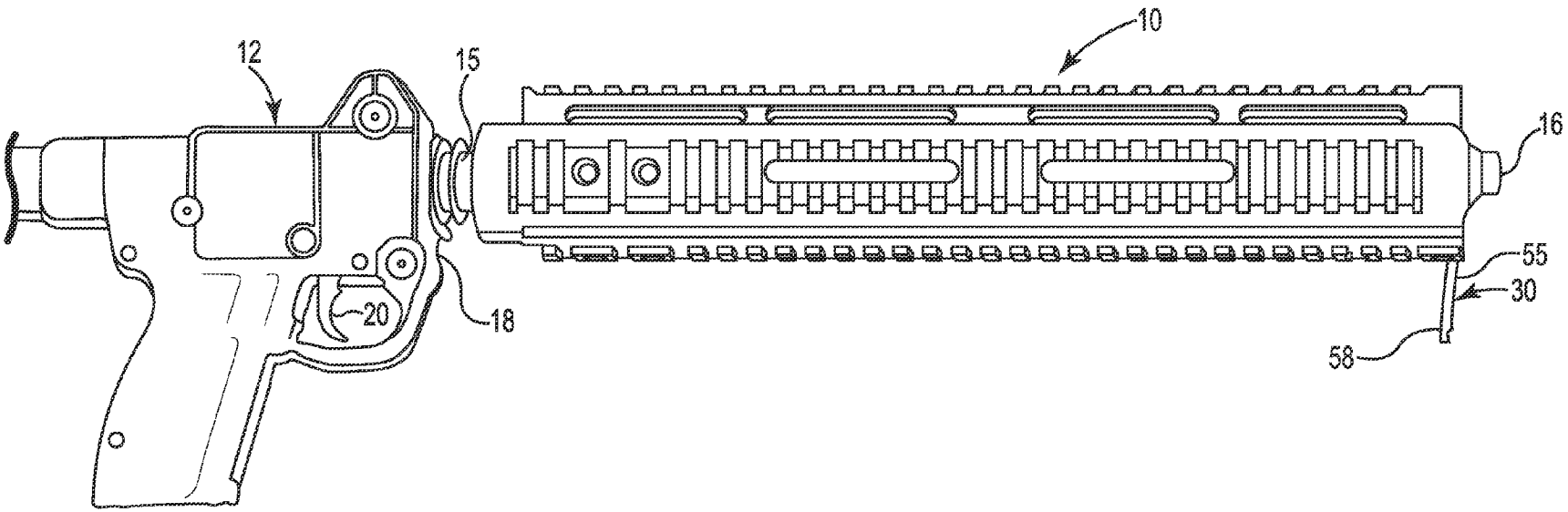
FIG. 3 is a side view of the first embodiment of the forearm/hand-guard assembly shown in FIGS. 1 and 2 attached to the firearm illustrated in FIG. 1.
Figure 4:
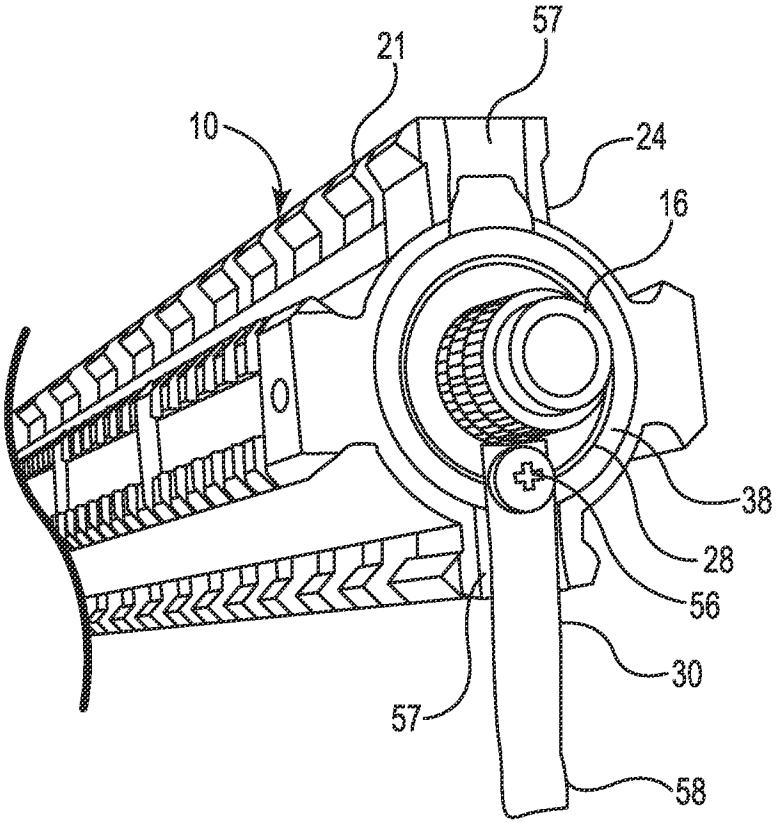
FIG. 4 is a fragmentary front end view in perspective of the forearm/hand-guard assembly shown in FIG. 1 attached to the firearm illustrated in FIG. 1.
Figure 5:
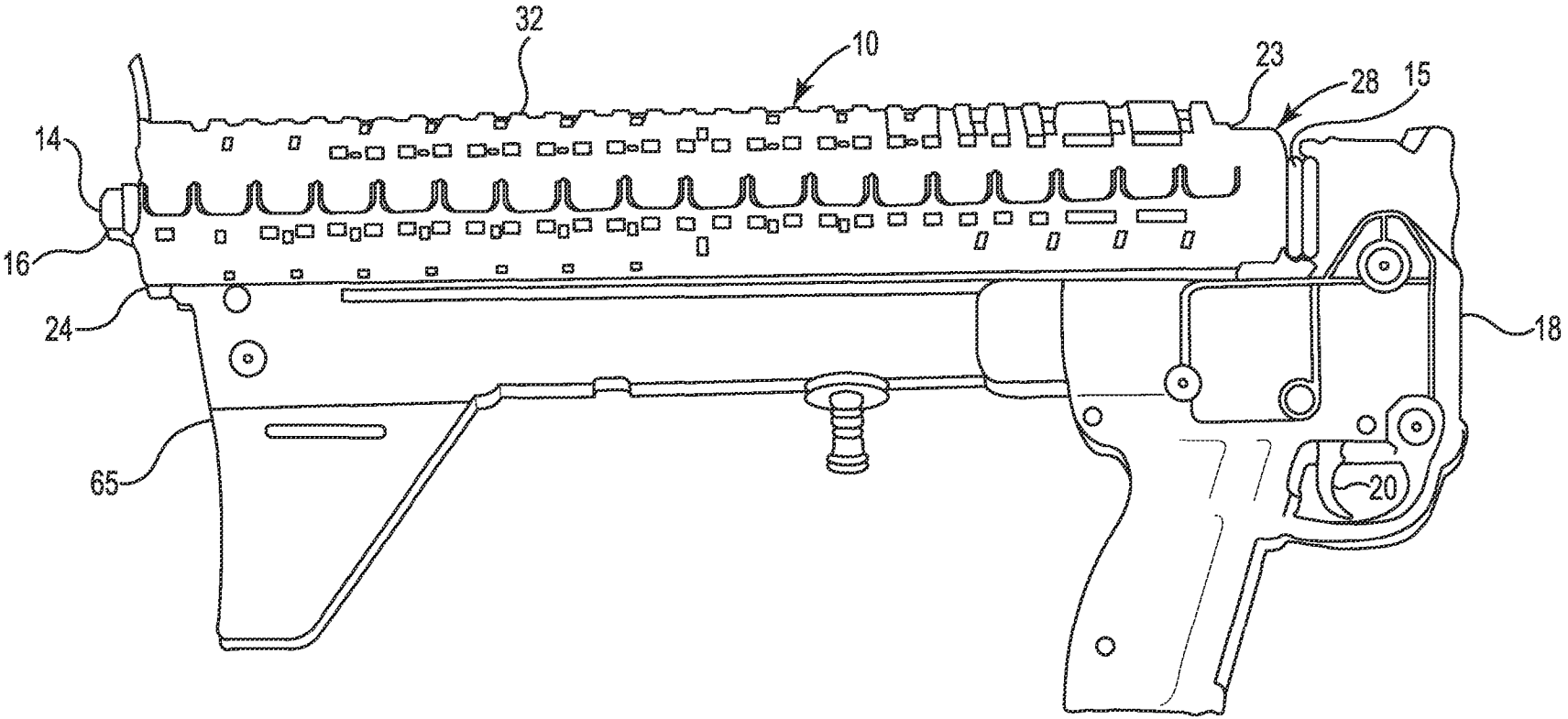
FIG. 5 is a side view of the forearm/hand-guard assembly shown in FIG. 1 attached to the firearm illustrated in FIGS. 1 and 3 in which a barrel of the firearm has been moved from its normal firing position illustrated in FIGS. 1 and 3 to a storage position which facilitates storage of the firearm.

As may best be seen in FIG. 2, the bearing means 28 comprises the inner surface 26 of the tubular member 21 having co-axial cylindrical inner surface portions 34*a* and 34*b* adjacent its end 23 and a cylindrical inner surface portion 34*c* adjacent its end 24; and first and second inner bearing portions 36 and 38 made of a polymeric material (e.g. Delrin or a metal such as aluminum). The first inner bearing portion 36 has co-axial cylindrical outer surface portions 39 and 40 adapted to be closely and rotateably received in the cylindrical inner surface portions 34*a* and 34*b* respectively of the tubular member 21. The second inner bearing portion 38 has a cylindrical outer surface portion 41 adapted to be closely and rotateably received in the cylindrical inner surface portion 34*c* of the tubular member 21 adjacent its end 24 to afford rotation of the tubular member 21 around the inner bearing portions 36 and 38.

The inner bearing portions 36 and 38 each have a surface (48 and 49 respectively) defining a through cylindrical opening having an axis parallel to and co-axial with the axis of its outer cylindrical surface 39 and 40 or 41. The openings defined by the surfaces 48 and 49 are adapted to receive spaced parts of the barrel 14 in close fitting relationship when the first inner bearing portion 36 is located adjacent the chamber end 15 of the barrel 14, and the first and second inner bearing portions are spaced within the tubular member 21 so that their outer cylindrical surfaces 39, 40, and 41 are within the cylindrical inner surface portions 34*a*, 34*b*, and 34*c* of the tubular member 21; and attachment means are provided for securing the inner bearing portions 36 and 38 in fixed positions on the portions of the barrel 14 extending through the through openings. That attachment means is provided by set screws 50 extending through a collar part 52 of the inner bearing portion 36 and a cylindrical part 38 of the second inner bearing portion 53. For the various embodiments, the inner bearing portion 36 and the cylindrical part 38 can be bored through off center to receive the barrel. This allows for additional clearance for the tubular member 21 to clear the buttstock when the barrel 14 is folded into the storage position.

The retaining means 30 includes a retaining member in the form of a flat spring 55 having one end attached by a screw 56 in a radially extending slot along the outer end surface of the second inner bearing portion 38. A portion of the spring 55 projects radially from the second inner bearing portion 38 and is biased toward engagement with one of two radially extending slots 57 in the second end 24 of the tubular member 21. A portion 58 of the spring 55 projects radially from the tubular member 21 where it can be manually engaged to deflect it and thereby remove the spring 55 from engagement with one of the slots 57 to afford manual rotation of the tubular member 21 with respect to the barrel 14.

Other embodiments for the retaining means are also possible. For example, as more fully discussed below, the retaining means for releasably retaining the tubular member 21 in at least one position relative to the barrel 14 can include an elongate retaining member having one end pivotally mounted by a pivot pin between spaced surfaces (e.g., projections) that extend from and/or are integrated into the bearing means 28. As with the spring 55, a portion of the retaining member can project radially outwardly from the bearing means 28 and is biased toward engagement with one of radially extending slots 57 of the tubular member 21 by a coil spring around the pivot pin and between the bearing means 28 and the retaining member. A portion of the retaining member projects radially from the tubular member 21 where it can be manually engaged to pivot it and thereby remove the retaining member from engagement with one of the slots 57 to afford manual rotation of the tubular member 21 with respect to the barrel 14.

The bearing means also includes means for restricting axial movement of the tubular member 21 with respect to the barrel 14. That means for restricting axial movement (best seen in FIG. 2) is provided by the tubular member 21 having a first retaining surface 60 extending generally radially outwardly from the end of the cylindrical inner surface portion 34*a* at the first end 23 of the tubular member 21 and a second retaining surface 61 extending generally radially inwardly from the inner end of the cylindrical inner surface portion 34*c* at the end 24 of the tubular member 21. The collar part 52 of the first inner bearing portion 36 has a third retaining surface 62 extending radially outwardly from one end of the outer cylindrical surface 39, and the part of the second inner bearing portion 38 having the outer cylindrical bearing surface 41 has a fourth retaining surface 63 extending radially inwardly from the inner end of the outer cylindrical bearing surface 41. The first and second retaining surfaces 60 and 61 on the cylindrical portion 21 that face away from each other are positioned in slidable contact with the third and fourth retaining end surfaces 62 and 63 on the inner bearing portions 36 and 38 when the inner bearing portions 36 and 38 are attached to the barrel in the spaced positions described above to thereby restrict axial movement of the tubular member 21 with respect to the barrel 14.

As noted in the background section of this application the chamber end 15 of the barrel 14 of the "SUB-2000" rifle 12 is mounted on its receiver 18 for pivotal movement between a use portion (see FIGS. 1 and 3) in which the barrel 14 projects away from its receiver 18 so that the rifle 12 can be used to fire cartridges, and a storage position (see FIG. 5) in which the barrel 14 is pivoted about 180 degrees around its juncture with the receiver 18 of the rifle 12 and lies along the top of the receiver 18 and a stock portion 65 of the rifle 12 so that the rifle 12 can be conveniently stored in a small storage case (not shown).

The use of the forearm/hand-guard assembly 10 according to the present invention allows use of an attachment (e.g., a scope or other type of sight, not shown) above the barrel 14 when the barrel 14 of the rifle is in its use position, and, when it is desired to store the rifle, allows the tubular member 21 to be manually rotated to move that attachment to one side of or below the barrel 14 so that the barrel 14 can be moved fully to its storage position facilitating storage of the rifle 12 in the small case.

With reference to FIGS. 6 through 11 there is illustrated a second embodiment of a forearm/hand-guard assembly according to the present invention, which assembly is generally designated by the reference numeral 110. The assembly 110 can be used on the firearm or rifle 12 commercially designated the "SUB-2000" from Kel-Tec CNC Industries, Inc. that is described above.

The forearm/hand-guard assembly 110 comprises a generally tubular member 121 (see FIGS. 6 and 7) having an axis 122, and first and second opposite axially spaced ends 123 and 124. The tubular member 121 includes means adapted for engagement to secure one or more attachments (e.g., open sights, red dot sights, scopes, lasers, or lights) along an outer surface of the tubular member 121. The tubular member 121 has an inner surface 126 defining a through opening between its ends 123 and 124, which inner surface 126 is adapted to extend around the barrel 14 of the rifle 12 with the inner surface 126 spaced from the barrel 14. The assembly 10 also includes bearing means 128 adapted for engagement around the barrel 14 for supporting the tubular member 121 around the barrel 14 from both ends 123 and 124 of the tubular member 121, which bearing means 128 affords rotation of the tubular member 121 around the barrel 14 between different positions relative to the barrel 14; and retaining means for releasably retaining the generally tubular member 121 in at least one of those positions relative to the barrel 14.

The tubular member 121 illustrated is the cast aluminum forearm/hand-guard structure sold under the trade designation "Short Carbine Length two piece tubular Handguard/Quad Rail" manufactured by AimSports Inc., San Gabriel, Calif. 91776. The means adapted for engagement to secure one or more attachments along the outer surface of the tubular member 21 comprises four integrally formed Picatinny rails 132 each extending between the ends 123 and 124 of the tubular member 121, which rails 132 are generally equally spaced around the outer surface of the tubular member 121.

Figures 6, 7, 8, 9, 10, 11:
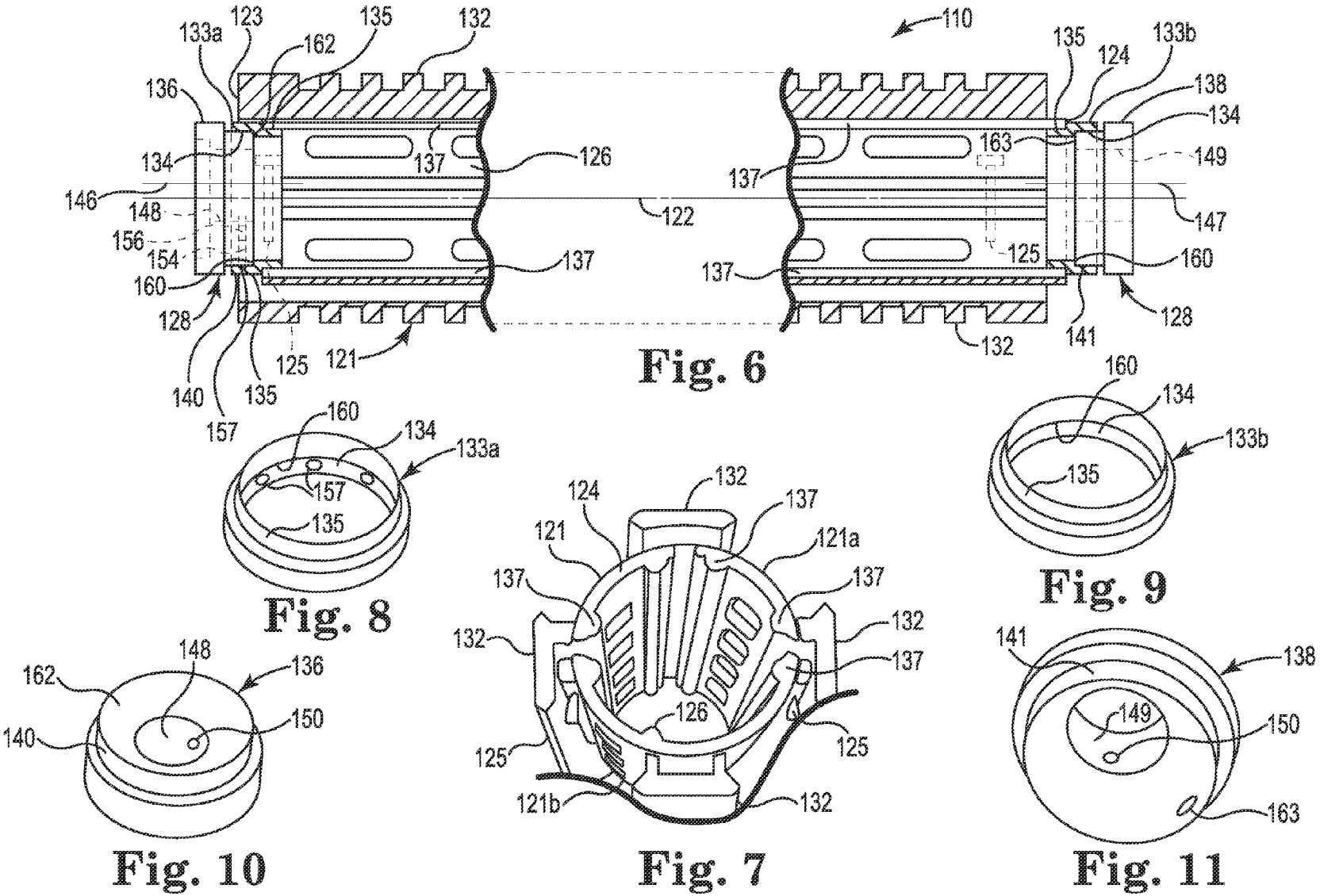
FIG. 6 is a side view of a second embodiment of a forearm/hand-guard assembly according to the present invention that shows sectioned fragments of a tubular member, sectioned outer bearing portions, and sectioned inner bearing portions, which tubular member, outer bearing portions, and inner bearing portions are included in the assembly.
FIG. 7 is an end view in perspective of the tubular member included in the second embodiment illustrated in FIG. 6.
FIGS. 8 and 9 are end views in perspective of the outer bearing portions included in the second embodiment illustrated in FIG. 6.
FIGS. 10 and 11 are end views in perspective of the inner bearing portions included in the second embodiment illustrated in FIG. 6.

As is best seen in FIG. 7, the tubular member 121 is an assembly of first and second semi-cylindrical parts 121*a* and 121*b*, each of which parts 121*a* and 121*b* extends between the ends 123 and 124 of the tubular member 121 and defines about one half of its inner surface 126. The part 121*a* includes two of the Picatinny rails 132 along its opposite sides and one of the Picatinny rails 132 midway there between. The second part 121*b* has opposite edge portions extending between its ends 123 and 124 that are positioned along the inner surfaces of the Picatinny rails 132 along the opposite sides of the first part 121*a*, and includes one of the Picatinny rails 132 midway between its edge portions. The parts 121*a* and 121*b* are attached together by four screws 125 that can pull the parts 121*a* and 121*b* toward each other to change the distance between the portions of the inner surface 126 on them.

The bearing means 128 comprises two metal (e.g., aluminum) bearing assemblies each including an outer bearing portion 133*a* or 133*b* having an outer cylindrical peripheral surface 135 and an inner cylindrical bearing surface 134. End portions of ribs 137 projecting inwardly along the inner surface 126 of the tubular member 121 engage the outer peripheral surfaces 135 of the outer bearing portions 133*a* or 133*b* with the outer bearing portions 133*a* or 133*b* in spaced relationship at the opposite ends 123 and 124 of the tubular member 121 and with their inner cylindrical bearing surfaces 134 around the same axis. The ribs 137 along the inner surface 126 on the parts 121*a* and 121*b* of the tubular member 121 are held in firm engagement with the outer peripheral surfaces 135 of the outer bearing portions 133*a* or 133*b* by the four screws 125 that bias those parts 121*a* and 121*b* toward each other.

The bearing assemblies also include first and second inner bearing portions 136 and 138 each having an outer cylindrical bearing surface (140 and 141 respectively) adapted to be closely and rotateably received in one of the cylindrical inner bearing surfaces 134 of the outer bearing portions 133*a* and 133*b* (i.e., the outer cylindrical bearing surface 140 in the inner cylindrical bearing surface 134 of the outer bearing portion 133*a* at its end 123 and the outer cylindrical bearing surface 141 in the inner cylindrical bearing surface 134 of the outer bearing portion 133*b* at its end 124) to afford rotation of the tubular member 121 around the inner bearing portions 136 and 138.

The inner bearing portions 136 and 138 each have a surface (148 and 149 respectively) defining a through cylindrical opening having an axis (146 and 147 respectively) parallel to but not co-axial with the axis of its outer cylindrical bearing surface 140 or 141. The openings defined by the surfaces 148 and 149 are adapted to receive spaced parts of the barrel 14 (e.g., FIGS. 1 and 5) in close fitting relationship when the first inner bearing portion 136 is located adjacent the chamber end 15 of the barrel 14, and the first and second inner bearing portions 136 and 138 are spaced within the outer bearing portions 133 secured in the tubular member 121 so that their outer cylindrical bearing surfaces 140 and 141 are within the cylindrical inner bearing surfaces 134 of the outer bearing portions 133*a* and 133*b*; and attachment means are provided for securing the inner bearing portions 136 and 138 in fixed positions on the portions of the barrel 14 extending through the through openings, which attachment means are provided by set screws 150 extending through internally threaded sockets in the inner bearing portions 136 and 138.

The retaining means comprises a detent assembly including (1) a cylindrical plunger 154 contained for axial sliding movement in a radially extending socket in the first inner bearing portion 136 and having a rounded tip that can project from the cylindrical bearing surface 140, which plunger 154 is biased radially outwardly of the socket by a spring 156 between the plunger 154 and an innermost end of the socket, and (2) a number (e.g., eight) of recesses 157 that are each adapted to receive the tip of the plunger 154 and are equally spaced around the cylindrical inner bearing surface 134 of the outer bearing portion 133*a*. The spring 156 force, tip shape, and recess 157 shapes are selected so that the plungers 154 engagement with one of the recesses 157 will retain the tubular member 121 in one position relative to the barrel 14 until a significant manual force is applied to rotate the tubular member 121 relative to the barrel 14, whereupon the shapes of the tip of the plunger 154 and the recess 157 will cam the plunger 154 into the socket against the bias of the spring 156 and allow the tubular member 121 to be rotated with less manual force until the next recess 157 along the inner bearing surface 134 reaches the plunger 154.

The bearing means also includes means for restricting axial movement of the tubular member 121 with respect to the barrel 14. That means for restricting axial movement is provided by the outer bearing portions 133*a* and 133*b* having first retaining surfaces 160 extending generally radially inwardly from the adjacent ends of the cylindrical inner bearing surfaces 134 at the opposite ends 123 and 124 of the tubular member 121; and the parts of the inner bearing portions 136 and 138 having the outer cylindrical bearing surfaces 140 and 141 each having an end retaining surface 162 and 163 respectively extending radially inwardly from one end of the outer cylindrical bearing surface 140 or 141 on the inner bearing portion 136 or 138. The opposed end retaining surfaces 162 and 163 are adapted to be positioned in slidable contact with the first retaining surfaces 160 on the outer bearing portions 133 when the inner bearing portions 136 and 138 are attached to the barrel 14 in the spaced positions described above to thereby restrict axial movement of the tubular member 121 with respect to the barrel 14.

The spacing between the parallel axes 146 and 147 of the through barrel receiving openings defined by the surfaces 148 and 149 and the outer cylindrical bearing surfaces 40 and 41 of the inner bearing portions 136 (e.g., a spacing of 0.25 inch) affords spacing the Picatinny rail 132 above the bore of the barrel 14 a distance that is less than one half of the distance from that Picatinny rail to the axis 122 of the tubular member 121. This may be desirable, for example, to locate a sight on one of the Picatinny rails 132 at the best available sighting level with respect to the barrel 14 of the rifle on which the assembly 110 is mounted, or to provide a small spacing of the Picatinny rail 132 above the barrel 14 to facilitate moving the barrel 14 of the rifle 12 to its storage position (described above) without contact between the tubular member 121 and the top of the receiver 18 or stock 65 on the rifle 12.

Figure 12:
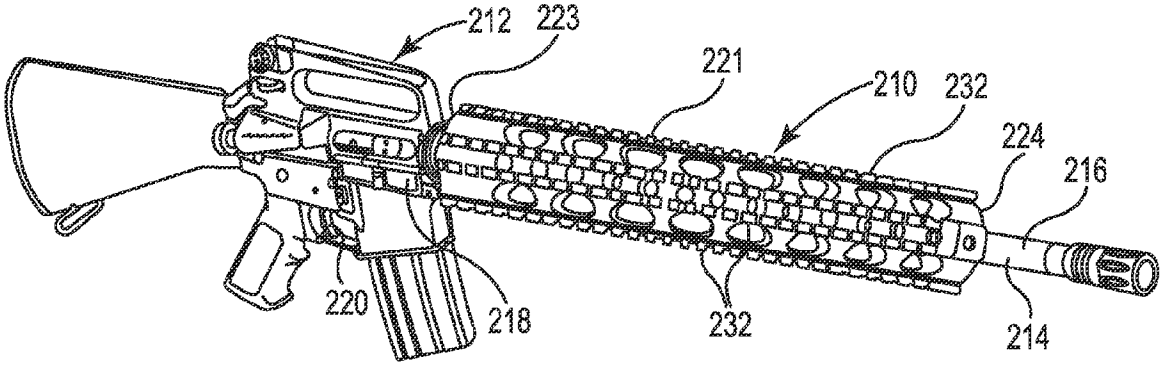
FIG. 12 is a side view of a third embodiment of a forearm/hand-guard assembly according to the present invention and of a firearm on which the forearm/hand-guard assembly is mounted.
Figure 13:
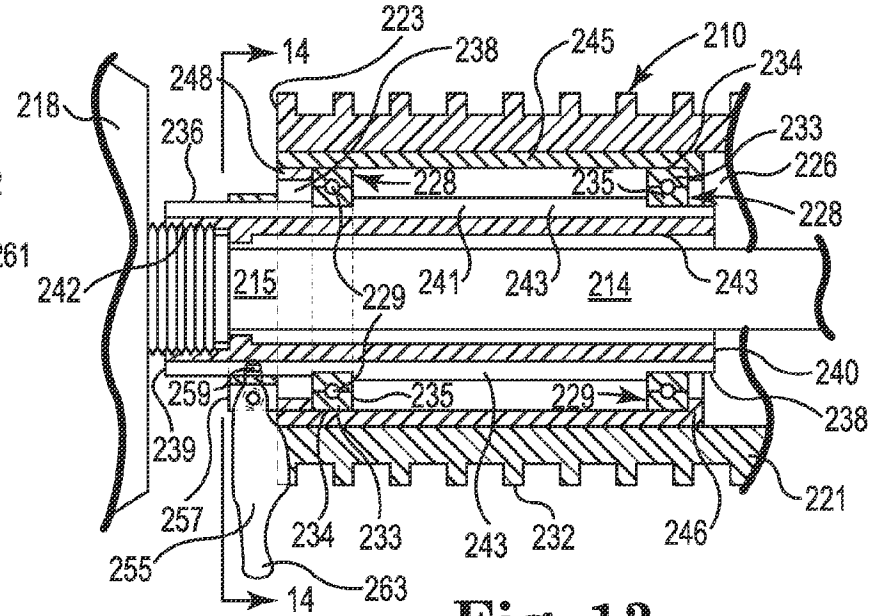
FIG. 13 is an enlarged fragmentary side view of the firearm and a tubular member included in the first embodiment of the forearm/hand-guard assembly shown in FIG. 1, together with a bearing support member and two roller bearings that support the tubular member on the bearing support member, which tubular member fragment, bearing support member and ball bearings have been sectioned to show details.
Figure 14:
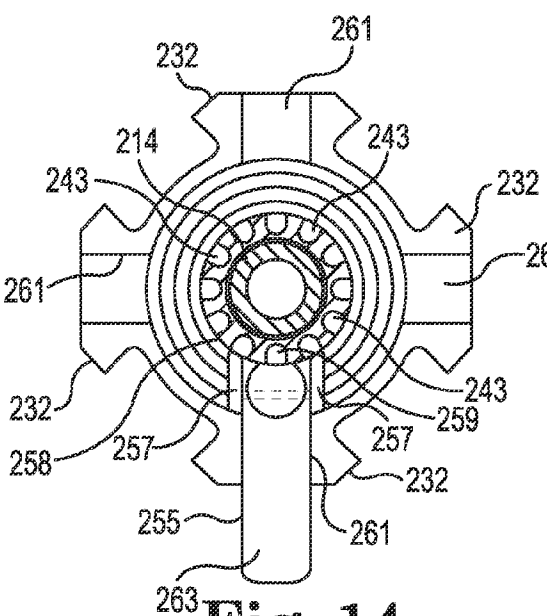
FIG. 14 is a cross sectional view taken approximately along line 14-14 of FIG. 13.

With reference to FIGS. 12 through 14 there is illustrated a third embodiment of a forearm/hand-guard assembly according to the present invention, which assembly is generally designated by the reference numeral 210; together with a firearm or rifle 212 on which the assembly 210 is adapted to be used, (e.g., the rifle 212 commercially designated an AR-15 Type Rifle that is commercially available from Smith & Wesson, 2100 Roosevelt Trail, Springfield, Mass. 01104; Bushmaster Firearms International, LLC, 999 Roosevelt Trail, Windham, Me. 04062; and/or DPMS Firearms, LLC, 3312 12$^{th}$ Street SE, St. Cloud, Minn. 56304). The rifle 212 includes an elongate barrel 214 having opposite chamber and muzzle ends 215 and 216 and a through bore from a chamber at its chamber end 215 to its muzzle end 216, a receiver 218 to which the chamber end 215 of the barrel 214 is attached, which receiver 218 includes means for securing a loaded cartridge in the chamber in the barrel 214, and means for affording manually activated firing of that cartridge by use of a trigger 220. A description of the rifle 212 available on the internet at http://www.bushmaster.com/catalog_xm15_PCWA2S20DCM8.asp, which is hereby incorporated herein by reference.

The forearm/hand-guard assembly 210 comprises a generally tubular member 221 having an axis, and first and second opposite axially spaced ends 223 and 224. The tubular member 221 includes means adapted for engagement to secure one or more attachments (e.g., open sights, red dot sights, scopes, lasers, or lights) along an outer surface of the tubular member 221. The tubular member 221 has an inner surface 226 defining a through opening between its ends 223 and 224, which inner surface 226 is adapted to extend around the barrel 214 of the rifle 212 with the inner surface 226 spaced from the barrel 214. The assembly 210 also includes bearing means adapted for supporting the tubular member 221 from the receiver 218 and around the barrel 214 from one end of the tubular member 221, which bearing means affords rotation of the tubular member 221 around the barrel 214 between different positions relative to the barrel 214; and retaining means for releasably retaining the generally tubular member 221 in at least one of those positions relative to the barrel 214.

The tubular member 221 illustrated is a modification of the forearm/hand-guard structure described above that is sold under the trade designation "Full length Free Float Handguard one piece tubular/Quad Rail" and is manufactured by Daniel Defense, Inc., Black Creed, Ga. 31308. The means adapted for engagement to secure one or more attachments along the outer surface of the tubular member 221 comprises four Picatinny rails 232 attached along the outer surface of the tubular member 221. The rails 232 extend between the ends 223 and 224 of the tubular member 221, and are generally equally spaced around the outer surface of the tubular member 221. Alternatively, the tubular member 221 could be a hollow tube with a generally cylindrical, rectangular, or other outer surface shape that has attached to its outer surface (e.g., as by soldering, welding, rivets, screws or otherwise) at least one or more structures such as Picatinny rails, Weaver style rails, or bases for scope rings that extend at least partially between its ends; or the tubular member could be tapped so attachments could be engaged directly to its outer surface by screws to provide the means adapted for engagement to secure one or more attachments along its outer surface.

The bearing means 228 comprises two thin single row radial ball bearings. For example, ball bearings 229 each including an outer bearing portion 233 having an outer cylindrical peripheral surface 234 and an inner cylindrical portion 235 having an inner through cylindrical passageway with balls in raceways between the bearing portions 233 and 235 affording relative rotation there between.

The bearing means 228 also includes a support member 236 for the inner bearing portions 235 of the bearings 229. The support member 237 has an outer cylindrical surface portion 238 at each of its opposite first and second ends 239 and 240, with each of which cylindrical surface portions 238 the cylindrical inner surface of one of the inner bearing portions 235 is engaged with a press fit to position adjacent sides of the inner bearing portions 235 against opposite ends of a larger diameter locating and spacing portion 241 of the support member 236 so that the bearings are co-axial and spaced apart (distance the bearings are spaced apart can depend upon the length of the tubular member 221). The support member 236 also has an internal surface defining a through passageway between its ends 239 and 240. The internal surface defining that through passageway includes (1) an internally threaded portion 242 adjacent the first end 239 of the support member 236 that corresponds in shape and threading to the internal shape and threading of the original barrel nut for the rifle 212, and (2) a cylindrical second portion 243 extending from the internally threaded end portion 242 to the second end 240 of the support member 236 that has a diameter larger than the diameter of the barrel 214 to provide a cooling space there between. To mount the assembly 210 on the rifle 212, the original barrel nut is removed and replaced by the internally threaded end portion of the support member 236 so that the internally threaded end portion of the support member 236 secures the barrel 214 to the receiver 218 of the rifle 212 and supports the support member 236 around the barrel 214 of the rifle 212. The support member 236 has a plurality of grooves 243 between its ends 239 and 240 and opening through its periphery that are closely spaced around its periphery and are each sized to receive the gas tube for the rifle 212 so that the gas tube can be positioned in the groove 243 positioned along the top of the barrel 214 after the internally threaded portion of the support member 236 is sufficiently engaged with the threads on the receiver 218 of the rifle 212 to secure the barrel 212 to the receiver 218 and then support the spaced bearings 229 on the support member 236 around the barrel 214.

A sleeve 245 having a cylindrical inner surface is attached to the inner surface 226 of the tubular member 221 and extends form the first end 223 of the tubular member 221 to a radially inwardly extending lip 246 on the sleeve 245. The cylindrical inner surface of the sleeve 245 closely receives the outer surfaces 234 of the outer portions 233 of the bearings 229 with the outer portion 233 of the bearing 229 adjacent the second end 240 of the bearing support member 236 against the lip 246. An annular ring 248 is attached by screws (not shown) to the inner surface of the sleeve 245 in a position against the outer portion 233 of the bearing 299 adjacent the first end 233 of the tubular member 221. Contact of the inner portions 235 of the bearings with the opposite sides of the locating and spacing portion 241 and contact of the outer portions 233 of the bearings 229 with the lip 246 and annular ring 248 provide means for restricting axial movement of the tubular member 221 with respect to the barrel 214 of the rifle 212 on which the assembly 210 is mounted.

The retaining means for releasably retaining the generally tubular member 221 in at least one position relative to the barrel 214 includes an elongate retaining member 255 having one end pivotally mounted by a pivot pin between spaced projections 257 from a collar 258 fastened around the cylindrical surface portion 238 of the support member 236 and located with respect to the support member 236 by a set screw 259 engaged with the bottom of the passageway 243 at the bottom of the barrel 214 of the rifle 212 on which the assembly 210 is mounted to position the elongate member 255 at the bottom of that barrel 214. A portion of the retaining member 255 projects radially outwardly from the support member 236 and is biased toward engagement with one of four radially extending slots 261 in the first end 223 of the tubular member 221 by a coil spring around the pivot pin and between the collar 258 and the retaining member 255. A portion 263 of the retaining member 255 projects radially from the tubular member 221 where it can be manually engaged to pivot it and thereby remove the retaining member 255 from engagement with one of the slots 261 to afford manual rotation of the tubular member 221 with respect to the barrel 214.

Three embodiments of a forearm/hand-guard assembly according to the present invention have now been described. It will be apparent to those skilled in the art that many changes can be made in the embodiments described without departing from the scope of the present invention. For example, for the assembly 210 described with reference to FIGS. 12 through 14 one wide roller bearing instead of two ball bearings could be used on the support member 236 to support the tubular member 221 from its end 223 adjacent the receiver 218 of the rifle 212. The axes of the through openings defined by the surfaces 48 and 49 of the inner bearing portions 36 and 38 of the assembly 10 could be spaced from the axes of the outer cylindrical surfaces 39, 40, and 41 in the manner and for the reasons described for the assembly 110 described with reference to FIGS. 6 through 11. The retaining means for the assembly 10 could have a structure similar to that of the retaining means for the assembly 210 illustrated in FIGS. 12 through 14, which structure could be mounted at either end of the tubular member 21. Thus, the scope of the present invention should not be limited to the structures of the embodiments described in this application, but only by the structures described by the language of the claims and the equivalents thereof.

What is clamed is:

1. A hand-guard assembly for a firearm including a barrel having an axis and a receiver, said hand-guard assembly comprising:

a hand-guard having a generally tubular member having an axis, first and second opposite axially spaced ends, and including means adapted for engagement to secure one or more attachments along an outer surface of the tubular member, said tubular member having an inner surface defining a through opening between said ends adapted to extend around the barrel of the firearm with the inner surface of the tubular member spaced from the barrel;

a bearing structure adapted for engagement with said firearm to support said tubular member around said barrel from at least one end of said tubular member, and for affording rotation of said tubular member around said barrel between different positions relative to said barrel, the bearing structure having a first inner bearing portion and a second inner bearing portion spaced apart from the first inner bearing portion, each of the first inner bearing portion and the second inner bearing portion having:

an outer surface portion that engages the inner surface of the generally tubular member to afford rotation of the generally tubular member around the bearing structure; and a surface defining a through cylindrical opening having an axis parallel to but not co-axial with an axis of the outer surface portion, the axis of the outer surface portion being an axis of rotation of the generally tubular member around the bearing structure, where the through cylindrical opening receives the barrel in a secure relationship; and retaining means for releasably retaining said generally tubular member in at least one of said positions relative to said barrel.

2. The hand-guard assembly of claim 1, wherein said bearing structure mounts said tubular member for rotation about an axis that is not coaxial with the axis of said barrel.

3. The hand-guard assembly of claim 1, wherein said bearing structure further includes: means for restricting axial movement of said tubular member relative to said barrel when said first inner bearing portion and said second inner bearing portion are secured to the barrel in spaced positions, said inner bearing portions being adapted to be attached to the barrel in said spaced positions to position the outer surface portions of said inner bearing portions within the inner surface of said generally tubular member, and said retaining means includes a retaining member adapted for releasable engagement between one of said bearing portions and said generally tubular member.

4. The hand-guard assembly of claim 1, wherein said means adapted for engagement to secure one or more attachments along the outer surface of the tubular member comprises at least one picatinny rail extending at least partway between said ends of the tubular member.

5. The hand-guard assembly of claim 1 wherein said means adapted for engagement to secure one or more attachments along the outer surface of the tubular member comprises four picatinny rails each extending at least partway between said ends of the tubular member, said rails being generally equally spaced around the outer surface of said tubular member.

6. A firearm comprising an elongate barrel having an axis, axially spaced chamber and muzzle ends, and a through bore from a chamber at said chamber end to said muzzle end, a receiver attached to said barrel at said chamber end, and a hand-guard assembly comprising:

a hand-guard having a generally tubular member having an axis, first and second opposite axially spaced ends, and including means adapted for engagement to secure one or more attachments along an outer surface of the tubular member, said tubular member having an inner surface defining a through opening between said ends and extending around the barrel with the inner surface of the tubular member spaced from the barrel;

a bearing structure to support said tubular member on said firearm around said barrel from at least one end of said tubular member, and for affording rotation of said tubular member between different positions relative to said barrel, the bearing structure having a first inner bearing portion and a second inner bearing portion spaced apart from the first inner bearing portion, each of the first inner bearing portion and the second inner bearing portion having:

an outer surface portion that engages the inner surface of the generally tubular member to afford rotation of the generally tubular member around the bearing structure; and a surface defining a through cylindrical opening having an axis parallel to but not co-axial with an axis of the outer surface portion, the axis of the outer surface portion being an axis of rotation of the generally tubular member around the bearing structure, where the through cylindrical opening receives the barrel in a secure relationship; and retaining means for releasably retaining said generally tubular member in at least one of said positions relative to said barrel.

7. The firearm of claim 6, wherein said bearing structure mounts said tubular member for rotation about an axis that is not coaxial with the axis of said barrel.

8. The firearm of claim 6 wherein said means adapted for engagement to secure one or more attachments along the outer surface of the tubular member comprises at least one picatinny rail extending at least partway between said ends of said tubular member.

9. The firearm of claim 6 wherein said means adapted for engagement to secure one or more attachments along the outer surface of the tubular member comprises four picatinny rails each extending at least partway between said ends of said tubular member, said rails being generally equally spaced around said tubular member.

* * * * *